US009896237B2

(12) United States Patent
Gogola et al.

(10) Patent No.: US 9,896,237 B2
(45) Date of Patent: Feb. 20, 2018

(54) CAN END TEAR PANEL WITH DECORATIVE RELIEF FEATURES

(71) Applicant: Rexam Beverage Can Company, Chicago, IL (US)

(72) Inventors: Michael R. Gogola, Itasca, IL (US); Jonathan P. Meyer, Chicago, IL (US); Rex Villasin, Schaumburg, IL (US)

(73) Assignee: REXAM BEVERAGE CAN COMPANY, Chicago, IL (US)

( * ) Notice: Subject to any disclaimer, the term of this patent is extended or adjusted under 35 U.S.C. 154(b) by 0 days.

(21) Appl. No.: 14/824,692

(22) Filed: Aug. 12, 2015

(65) Prior Publication Data

US 2017/0043903 A1 Feb. 16, 2017

(51) Int. Cl.
*B65D 17/34* (2006.01)
*B65D 17/00* (2006.01)

(52) U.S. Cl.
CPC ..... *B65D 17/161* (2013.01); *B65D 17/165* (2013.01); *B65D 2517/0011* (2013.01)

(58) Field of Classification Search
CPC ..... B65D 17/165; B65D 2517/0013; B65D 2251/06; B65D 17/161; B65D 2517/0011
USPC ..... 220/269, 376; 40/311
See application file for complete search history.

(56) References Cited

U.S. PATENT DOCUMENTS

| | | | |
|---|---|---|---|
| 4,402,421 | A | 9/1983 | Ruemer, Jr. |
| 5,715,964 | A | 2/1998 | Turner et al. |
| 6,024,239 | A | 2/2000 | Turner et al. |
| 6,161,717 | A | 12/2000 | Forrest et al. |
| 6,164,480 | A | 12/2000 | Heinicke et al. |
| 6,330,954 | B1 | 12/2001 | Turner et al. |
| 6,575,684 | B2 | 6/2003 | Heinicke et al. |
| 6,715,629 | B2 | 4/2004 | Hartman et al. |
| 6,761,281 | B2 | 7/2004 | Hartman |
| 8,567,158 | B2 | 10/2013 | Chasteen et al. |
| 8,646,643 | B2 | 2/2014 | Forrest et al. |
| 8,939,308 | B2 | 1/2015 | Ramsey et al. |
| 2001/0002671 | A1 | 6/2001 | Heinicke et al. |
| 2009/0200304 | A1 | 8/2009 | Wendle |
| 2011/0226636 | A1 | 9/2011 | Petti |
| 2012/0269934 | A1 | 10/2012 | Ramsey et al. |
| 2014/0096491 | A1 | 4/2014 | Chasteen et al. |

FOREIGN PATENT DOCUMENTS

| | | | |
|---|---|---|---|
| WO | 2007007102 | A2 | 1/2007 |

OTHER PUBLICATIONS

International Search Report and Written Opinion for PCT/2016/046770, dated Oct. 28, 2016, 12 pages.

*Primary Examiner* — James N Smalley
(74) *Attorney, Agent, or Firm* — Greer, Burns & Crain, Ltd.

(57) ABSTRACT

An ecology stay-on tab beverage can end has a center panel having a public side and an opposing product side. The center panel has a displaceable tear panel defined by a frangible score groove and a non-frangible hinge portion of the center panel located between a first end and a second end of the frangible score which retains the displaceable tear panel to the center panel subsequent to opening. The displaceable tear panel has a symbol thereon. The symbol conveys information to a user and is formed by a relief feature on the tear panel. The symbol and the relief feature are spaced at least 0.050 inches radially inwardly of the frangible score groove such that no portion of the symbol and the relief feature are closer than 0.050 inches to the frangible score.

34 Claims, 12 Drawing Sheets

CAN END TEAR PANEL WITH DECORATIVE RELIEF FEATURES

CROSS-REFERENCE TO RELATED APPLICATIONS

N/A

FEDERALLY SPONSORED RESEARCH OR DEVELOPMENT

N/A

TECHNICAL FIELD

The invention relates to beverage can ends having a stay-on tab ecology opening assembly; more particularly, the present invention is related to a metallic beverage can end having information-conveying indicia on a displaceable tear panel of a stay-on-tab ecology opening assembly.

BACKGROUND OF THE INVENTION

Typical end closures for beer and beverage containers have an opening panel and an attached leverage tab for pushing the opening panel into the container to open the end. The container is typically a drawn and ironed metal can, usually constructed from a thin plate of aluminum. End closures for such containers are also typically constructed from a cutedge of thin plate of aluminum or steel, formed into a blank end, and manufactured into a finished end by a process often referred to as end conversion.

These types of container ends have been used for many years, with almost all such ends in use today being the "ecology" or "stay-on-tab" ("SOT") ends in which the tab remains attached to the end after a tear panel, including large-opening ends ("LOE"), is opened. The tear panel being a portion of the can end defined by a frangible score length and a non-frangible hinge segment. The tear panel may be opened, that is the score may be severed, and the tear panel displaced at an angular orientation relative to the remaining portion of the can end, thus creating a pour opening through which the beverage may be poured from the container. The tear panel remains hingeably connected to the remaining portion of the can end by the non-frangible hinge segment, leaving an opening through which the user draws the contents of the container. In an LOE, the pour opening is about 0.5 square inches in area.

Opening of the tear panel is operated by the tab which is attached to the can end by a rivet through a rivet island on the tab. The tab is typically attached to the can end such that a nose of the tab extends over a proximal portion of the tear panel in a stowage position. A lift end of the tab is located opposite the tab nose and provides access for a user to lift the lift end, such as with the user's finger, to force the nose against the proximal portion of the tear panel. With most can ends, the stowage position and opening position are in the same location; however, some can ends known in the art require rotation of the tab from a stowage position to the opening position prior to an opening sequence, i.e. the fracturing of the frangible score.

When the tab nose is forced against the tear panel, the score initially ruptures at a vent region of the score. This initial rupture of the score is primarily caused by the lifting force on the tab resulting in lifting of a central region of the can end, including the rivet and immediately adjacent the rivet. As the tab is lifted further, the score rupture propagates along the length of the score, eventually stopping at the hinge segment.

Venting is an initial release of pressure from within a pressurized container upon initial fracture of the score about the tear panel, typically upon the initial lifting of the lift end of the tab by a user.

In general, beverage can end design requires a careful balancing of structural elements to achieve a beverage can end of a desired strength while maintaining proper function of the SOT opening assembly. Changes to one structural element to improve one physical characteristic of the beverage can end will routinely adversely affect a different physical characteristic.

For example, strengthening the can end through localized coining, or the compression of the metal to produce a localized region of reduced thickness, will create a volume of excess metal that typically must be used to form some structure, else it could have an adverse effect on performance of the can end. Oil can-effect or warping of the center panel often results from coining or other processes that create a localized excess volume of metal.

Additionally, if a designer selects a score line depth which is too deep, the resulting can ends are subject to being ruptured during the production and during packaging and shipping operations. On the other hand, if the score depth is too shallow, excessive force may be required to rupture the score. In such a situation, even if the user is physically able to apply sufficient force to rupture the score line, the tab and the tear panel itself may deform in a manner to prevent complete rupture of the full length of the score.

It is desirable to have a tear panel that is stiff and resists deformation during the opening procedure. The tendency of a tear panel to deform excessively during score rupture is to a large extent, a function of the relative stiffness of the tear panel. The stiffness of a tear panel may, in turn, be influenced by the metal gauge, i.e., the thickness of the tear panel, and also the amount of "slack", or localized excess, metal in the tear panel. Tear panel slack may be produced by various sources including rivet formation and also the very scoring needed to create a tear panel. The relative size of a tear panel also affects the rupture performance of a tear panel since a panel of larger area tends to bend more and thus diffuse the rupture force applied by the tab more than a smaller tear panel of the same metal gauge.

One common technique used for increasing the relative stiffness of a tear panel is to create a deboss panel which circumscribes the tear panel and rivet and in which the tear panel and the rivet are recessed.

Another technique is to form a raised or "embossed" metal bead in the middle of the tear panel to take up metal slack. The tear panel may also have a deboss bead. The deboss bead may have a surface portion which ramps upwardly and radially inwardly, relative to an axis passing through the staked portion of the tab and oriented generally normal to the generally flat, radially extending surface. In either case, the bead structure is formed in a shape which generally follows the geometric shape of the score of the tear panel, thereby evenly drawing slack metal from the tear panel. The bead structure may also be used to provide better leverage by opening force on the tear panel by the tab.

Thus, the structure of the beads on the tear panel, including placement, depth/height, shape, surface area, and volume are of the utmost importance in the functionality and operation of the can end overall and, in particular, performance during the severing of the frangible score during opening. For this reason, there have been no known efforts to use the tear panel as a means for conveying information to a user through beading or other structures. Again, any structural change to the tear panel would have an effect on can end performance. Any non-uniform, irregular shaped bead could place unwanted forces on the frangible score. Additionally, any coining or additional scoring could create slack metal in the tear panel that would adversely affect can end openability.

Prior art can ends have been used to convey information to users. Recycling instructions, manufacturing codes, and the like have been incised or scored into a public surface of a center panel of the can end and outside a perimeter of the tear panel. The alpha-numeric symbols used to convey information are typically very shallow. Typically, emboss and deboss beads are not employed.

More recently, and with some success, the tab has been used to convey information to users. This information may be in the form of promotional materials, logos, or the like. Methods such as printing, incising, laser ablation, stamping, beading, etc. have been proposed to provide information on the tabs. The tab is used for this purpose because changes to the tab are less likely to adversely affect beverage can end performance. However, the available surface area on the tab is very limited for these purposes, even when enclosing the finger hole to create a billboard-like surface on the tab.

The inventors have identified a commercial need to expand the use of information-conveying symbols on can ends. It would be desirable to utilize a larger surface area of the can end in a more prominent location on the center panel, wherein a user is naturally encouraged to view the information carrying symbols in the manner intended by the designers. The tear panel is the most likely location for such symbol due to its location on the center panel and because the tear panel naturally faces the user when the user lifts the tab to begin an opening sequence of the can end. However, the structural importance of the tear panel during manufacturing and during the severing of the frangible score have generally eliminated the tear panel from consideration for communicating information in the form of structural symbols to a user.

Thus, the problem addressed by the inventors can be stated: In a beverage can end or lid comprising a stay-on-tab ecology opening assembly, where is a desirable location for information-communicating symbols on a public side of a center panel; and what are the structural requirements of a displaceable tear panel having information-communicating structural elements thereon when the stay-on-tab opening assembly and the beverage can end must maintain the physical and functional properties required of a properly opening beverage can.

The present invention is provided to solve the problems discussed above and other problems, and to provide advantages and aspects not provided by prior can ends of this type. A full discussion of the features and advantages of the present invention is deferred to the following detailed description, which proceeds with reference to the accompanying drawings.

SUMMARY OF THE INVENTION

A first aspect of the present invention is directed to a beverage can end. The beverage can end has a circumferential curl positioned about a longitudinal axis defining a perimeter of the beverage can end. A circumferential wall is positioned radially inwardly of the circumferential curl and extends downwardly therefrom. A center panel is located radially inwardly of the circumferential wall and has a public side and an opposing product side. A frangible score groove is within the center panel and has a first end spaced from a second end. A displaceable tear panel is defined by the frangible score groove and a non-frangible hinge portion of the center panel located between the first end and the second end of the frangible score which retains the displaceable tear panel to the center panel subsequent to opening. The displaceable tear panel comprises a symbol formed from a relief feature. The symbol conveys information to a user and is spaced at least 0.050 inches radially inwardly of the frangible score groove such that no portion of the symbol and the relief feature are closer than 0.050 inches to the frangible score. A tab has a lift end and a nose end opposite the lift end extending over a portion of the displaceable tear panel. A rivet attaches the tab to the center panel. A means for strengthening the beverage can end is located radially outwardly of the center panel between the center panel and the circumferential wall.

This aspect of the invention may include one or more of the following features, alone or in any reasonable combination. The beverage can end may further comprise a score groove in the displaceable tear panel located at least 0.050 inches radially inwardly of the frangible score groove and forming a portion of the symbol conveying information to a user. The depth of the score groove is no greater than 0.001 inches. The score groove may be asymmetrical relative to a first diametric axis extending through a center of the rivet and the lift end and the nose end of the tab. The score groove may be asymmetrical relative to the frangible score groove. The score groove may be located completely beyond a perimeter of the tab. The score groove may be located entirely within an arc area of an arc of a circle subtending an angle of less than 120 degrees, having a center point common with a center of the rivet, and bisected by the first axis. The score groove may be located within a surface area of a bead forming a first relief feature on the public side of the tear panel and a corresponding second relief feature on the product side of the tear panel. The bead may also form a portion of the symbol for conveying information to a user. The beverage can end may further comprise a plurality of score grooves in the displaceable tear panel located at least 0.050 inches radially inwardly of the frangible score groove and forming a portion of the symbol conveying information to a user wherein no portion of the plurality of score grooves is closer than 0.050 inches to the frangible score. An anti-fracture score may be spaced from the frangible score and generally follow a shape thereof. A portion of the symbol may be coined to produce a localized segment of reduced thickness of the tear panel relative a thickness of adjacent portions of the tear panel. The symbol may include a layer of pigment deposited thereon.

The first aspect of the invention may include one or more of the following features, alone, in combination, or in combination with the features set forth in the preceding paragraph. The beverage can end may further comprise a plurality of beads formed in the displaceable tear panel displacing the public side and the product side of the center panel in an axial direction defined by the longitudinal axis, each bead having an outer perimeter spaced at least 0.050 inches from the frangible score groove over an entire length of an outer perimeter of the bead, wherein each bead forms at least a portion of the symbol for conveying information to a user. Each bead may be asymmetrically positioned on the tear panel relative to a first diametric axis extending through a center of the rivet and lift end and the nose end of the tab. Each bead may be located entirely within an arc area of an arc of a circle subtending an angle of less than 120 degrees, having a center point common with a center of the rivet, and bisected by the first axis. A first bead in the plurality of beads may be embossed and a second bead in the plurality of beads may be debossed. At least one of the beads may have a depth that varies over a surface area of the at least one bead, wherein the depth becomes shallower in an axial direction defined by the longitudinal axis as a distance from the tab increases, and wherein the at least one bead is a recess in the tear panel relative to the public side. The symbol may be a citrus fruit. At least one of the beads may be a continuous curvilinear bead forming a narrow channel in the tear panel. A depth of each bead may be inversely proportional to a surface area of the bead. Each of the plurality of beads may be a deboss bead. Each of the plurality of beads may be an emboss bead. A height of each bead may be inversely proportional to a surface area of the bead. At least one bead of the plurality of beads may have a height that varies over a surface area of the at least one bead, wherein the height becomes shallower in an axial direction defined by the longitudinal axis as a distance from the tab increases, and wherein the at least one bead is raised in the tear panel relative to the public side. The plurality of beads may improve the stiffness of the tear panel. A depth of each bead may be inversely proportional to an area of an opening of the bead. A height of each bead may be inversely proportional to an area of an opening of the bead.

A second aspect of the invention is also directed to a beverage can end. The beverage can end comprises a circumferential curl positioned about a longitudinal axis defining a perimeter of the beverage can end. A circumferential wall is positioned radially inwardly of the circumferential curl and extends downwardly therefrom. A center panel is located radially inwardly of the circumferential wall and has a public side and an opposing product side. A frangible score groove is located within the center panel and has a first end spaced from a second end. A displaceable tear panel is defined by the frangible score groove and a non-frangible hinge portion of the center panel located between the first end and the second end of the frangible score which retains the displaceable tear panel to the center panel subsequent to opening. The displaceable tear panel comprises a bead formed in the displaceable tear panel displacing the public side and the product side of the center panel in an axial direction defined by the longitudinal axis. The bead has an outer perimeter spaced at least 0.050 inches from the frangible score groove over an entire length of the outer perimeter. The bead forms at least a portion of a symbol having a shape adapted to convey information to a user. A tab has a lift end and a nose end extending over a portion of the displaceable tear panel. A rivet attached the tab to the center panel. A means for strengthening the beverage can end is located radially outwardly of the center panel between the center panel and the circumferential wall. The center panel may have a deboss panel recessed in the center panel. The frangible score groove may be within the deboss panel.

A third aspect of the invention is directed to a beverage can end. The beverage can end comprises a circumferential curl positioned about a longitudinal axis defining a perimeter of the beverage can end. A circumferential wall is positioned radially inwardly of the circumferential curl and extends downwardly therefrom. A center panel is located radially inwardly of the circumferential wall and has a public side and an opposing product side. The frangible score groove is located within the center panel and has a first end spaced from a second end. A displaceable tear panel is defined by the frangible score groove and a non-frangible hinge portion of the center panel located between the first end and the second end of the frangible score which retains the displaceable tear panel to the center panel subsequent to opening. The displaceable tear panel comprises a plurality of beads formed in the displaceable tear panel wherein each bead displaces a portion of the center panel in an axial direction defined by the longitudinal axis, wherein a first displacement distance of the center panel caused by a first bead is greater than a second displacement distance of the center panel caused by a second bead, wherein the plurality of beads in combination form a portion of a symbol conveying information to a user. A tab has a lift end and a nose end opposite the lift end extending over a portion of the displaceable tear panel. A rivet attaches the tab to the center panel. A means for strengthening the beverage can end is located radially outwardly of the center panel between the center panel and the circumferential wall. The center panel may have a deboss panel recessed in the center panel. The frangible score groove may be within the deboss panel.

A fourth aspect of the invention is directed to a beverage can end. The can end comprises a circumferential curl positioned about a longitudinal axis defining a perimeter of the beverage can end. A circumferential wall is positioned radially inwardly of the circumferential curl and extends downwardly therefrom. A center panel is located radially inwardly of the circumferential wall and has a public side and an opposing product side. A frangible score groove is within the center panel and has a first end spaced from a second end. A displaceable tear panel is defined by the frangible score groove and a non-frangible hinge portion of the center panel located between the first end and the second end of the frangible score which retains the displaceable tear panel to the center panel subsequent to opening. The displaceable tear panel comprises a symbol for conveying information to a user comprising a bead in the tear panel, wherein the bead displaces a portion of the center panel in an axial direction defined by the longitudinal axis forming a high relief feature and a low relief feature on opposing the public and product sides of the tear panel, wherein a depth and a surface area of the bead are selected to maintain a desired stiffness of the displaceable tear panel to improve openability of the tear panel. A tab has a lift end and a nose end opposite the lift end extending over a portion of the displaceable tear panel. A rivet attaches the tab to the center panel. A means for strengthening the beverage can end is located radially outwardly of the center panel between the center panel and the circumferential wall. The center panel may have a deboss panel recessed in the center panel. The frangible score groove may be within the deboss panel.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
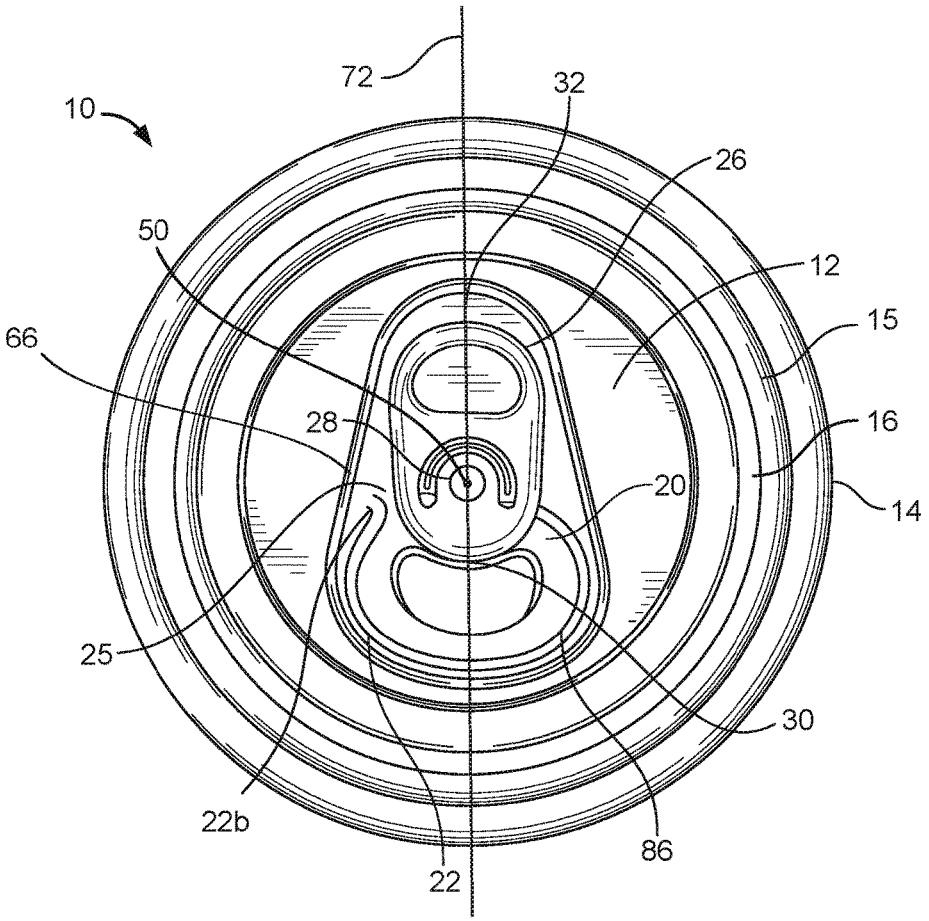
FIG. 1 (PRIOR ART)
FIG. 1 is a top view of an SOT beverage can end that is known in the art of beverage can end design.
Figure 2:
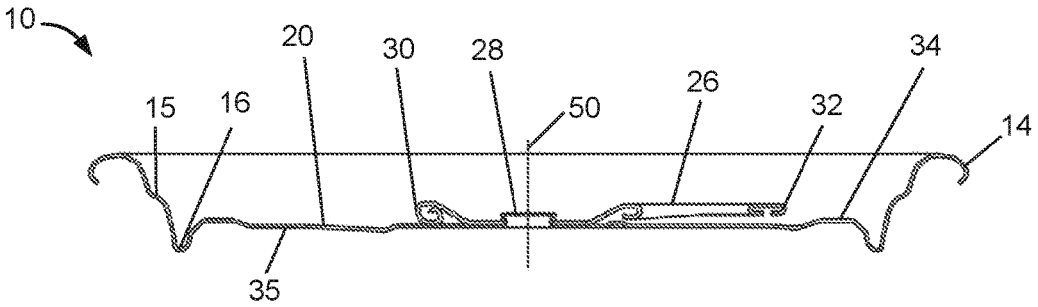
FIG. 2 (PRIOR ART)
FIG. 2 is a cross-sectional view of the can end of FIG. 1 taken through a central axis.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention provides a beverage can end aimed at providing a tear panel having information communicating indicia. The indicia of the present invention may be in the form of one or more shallow scores, raised beads, or recessed beads in the tear panel of the beverage can end. The inventors discovered that carefully controlling various structural parameters of the indicia allows this type of indicia to be placed on the tear panel. This was previously considered to have a deleterious effect and, consequently, rarely, if ever, proposed.

Referring generally to the figures, a beverage can end 10 for a container (not shown) has a center panel 12 separated from a seaming curl 14 by a circumferential wall 15 extending downwardly from the seaming curl 14 to a strengthening segment 16 which is joined to the center panel 12. The container is typically a drawn and ironed metal can, usually constructed from a thin plate of aluminum or steel. Beverage can ends for such containers are also typically constructed from a cutedge of thin plate of aluminum or steel, formed into blank end, and manufactured into a finished end by a process often referred to as end conversion.

The can end 10 can be joined to a container body by the seaming curl 14 which is joined to a mating curl of the container body. The seaming curl 14 of the can end 10 is integral with the center panel 12 by the circumferential wall 15 and the strengthening segment 16, typically either a generally U-shaped countersink or a fold, which is joined to a peripheral edge of the center panel 12, defining an outer perimeter of the center panel 12, often through an additional strengthening feature such as a circumferential step or other circumferential wall. This type of means for joining the center panel 12 to a container body is presently the typical means for joining used in the industry, and the curl structure described above is formed in the process of forming the blank end from a cutedge of metal plate, prior to the end conversion process. However, other means for joining the beverage can end to a container body may be employed with the present invention.

The steps of manufacturing the can end 10 begin with blanking the cutedge, typically a round or non-round cutedge of thin metal plate. Examples of non-round cutedge blanks include elliptical cutedges, convoluted cutedges, and harmonic cutedges. A convoluted cutedge may be described as generally having three distinct diameters, each diameter being 45° relative to the others. The cutedge is then formed into a blank end by forming the seaming curl, countersink, panel radius and the center panel.

The conversion process for this type of beverage can end includes the following steps: forming a rivet by first forming a projecting bubble in the center of the panel and subsequently working the metal of the bubble into a button and into the more narrow projection of metal being the rivet; forming the tear panel by scoring the metal of the panel wall; forming an inner bead or panel on the tear panel; forming strengthening feature either through a deboss panel by bending the metal of the center panel such that a central area of the center panel is slightly lower than the remaining center panel or a bead surrounding the frangible score; staking a tab to the rivet; and other subsequent operations such as wipe-down steps to remove sharp edges of the tab, lettering on the center panel by scoring, incising, or embossing (or debossing), and restriking the rivet island.

The circumferential seaming curl 14 defines an outer perimeter of the beverage can end 10. It is generally centered about a longitudinal or vertical axis 50, typically located at a center of the rivet.

The center panel 12 has a displaceable tear panel 20 defined by a frangible score and a non-frangible hinge segment 25. The tear panel 20 of the center panel 12 may be opened, that is the frangible score may be severed and the tear panel 20 displaced at an angular orientation relative to the remaining portion of the center panel 12, while the tear panel 20 remains hingeably connected to the center panel 12 through the hinge segment 25, to define a dispensing port or pour opening. In this opening operation, the tear panel 20 is displaced at an angular deflection. More specifically, the tear panel 20 is deflected at an angle relative to a plane of the center panel 12, with the vortex of the angular displacement being the hinge segment 25.

The tear panel 20 is formed during the conversion process by a scoring operation. The tools for scoring the tear panel 20 into the center panel 12 include an upper die on a public side 34 having a scoring knife edge in the shape of the tear panel 20, and a lower die on the product side 35 to support the metal in the regions being scored. When the upper and lower dies are brought together, the metal of the center panel 12 is scored between the dies. This results in the scoring knife edge being embedded into the metal of the center panel 12, forming a score groove 22 which appears as a wedge-shaped recess in the metal. The metal remaining below the wedge-shaped recess is the residual of the score groove 22. Therefore, the score groove 22 is formed by the scoring knife edge causing movement of metal, such that the imprint of the scoring knife edge is made in the public side 34 of the center panel 12.

The center panel 12 has a public side 34 and an opposing product side 35 and further includes a tab 26. The tab 26 has a generally elongated body along a diametric first axis 72 extending through a tab nose 30, a central webbing and the lift end 32. Typical prior art can ends often have a tab 26 which is staked in the final steps of the conversion process by staking the area of the center panel 12 adjacent and under the rivet island 46 at an angle, to bias the tab 26 such that the lift end 32 of the tab 26 rests close to the center panel 12. The center panel 12 may also have a recess near the lift end 32 of the tab 26 to allow for easier finger access.

The opening of the tear panel 20 is operated by the tab 26 which is attached to the center panel 12 by a rivet 28 spaced from the tear panel 20, generally through a rivet aperture in a rivet island of the tab 26. The lift end 32 of the tab 26 is located opposite the tab nose 30. Typically, the central webbing of the tab provides access for a user to lift the lift end 32, such as with the user's finger.

Alternatively, the tab 26 may be attached to the center panel 12 by an adhesive.

The rivet 28 is surrounded by a circular coined region of the center panel 12. The coined region is a compressed portion of the center panel 12 having a localized reduced thickness relative to adjacent portions of the center panel. The score groove 22 generally includes a segment that travels through this coined region. A raised, curvilinear bead may be located about the coined region so that it partially surrounds the coined region without intersecting or extending onto the tear panel 20.

If the strengthening feature is a deboss panel 66, it is formed in the public side 34 of the central panel 12. The deboss panel 66 is formed in the central panel 12 using conventional die-forming techniques. The tab 26 and the tear panel 20 are typically fully recessed within the deboss panel 66. A strengthening feature taking the form of a bead surrounding the frangible score is also formed using conventional die-forming techniques.

For purposes of description and location of elements, the first axis 72 of the can end 10 extends through the nose end 30 and lift end 32 of the tab 26 and through a center of the rivet 28. The first axis 72 will generally bisect a tab of bilateral symmetry as illustrated. Thus, the first axis 72 travels along a diameter of the can end 10, assuming a round can end 10.

As illustrated, for discussion purposes, and as is the case for all known commercially available beverage containers of this type, the score groove 22 has first end located under the tab 26 separated from a terminal end **22*b* by the non-frangible hinge portion 25. A portion of the score groove 22 is severed during an opening sequence which progresses in a clockwise fashion from a vent region towards the terminal end 22***b* of the score line 22. One of ordinary skill in the art could readily adapt the teachings set forth herein to a can using a counterclockwise opening sequence if so desired.

Starting with the beginning end and moving clockwise about the score line 22, the score line comprises a vent region located at least partially beneath the tab 26 and has a segment lying very close to the rivet 28. As will be described below, the vent region is the portion of the score groove 22 where opening of the tear panel 20 is initiated. The vent region is where an initial "pop" takes place and where an internal pressure within beverage container is safely exhausted during the opening sequence as the score line 22 in the vent region is fractured. The concept of a vent region is generally well-known in the prior art.

An anti-fracture score 86 may be place adjacent the score line 22 as is known in the art. The anti-fracture score 86 is generally a shallower score relative to the frangible score groove 22. It follows a path generally parallel to a path followed by the frangible score groove 22 over most of its length, typically departing from this parallel path at the first end of the score groove 22 and spaced from the frangible score groove 22 less than 0.05 inches. The anti-fracture score 86 is optional, depending on the strengthening feature of the center panel. When provided, it is typically located on the tear panel 20, but may be located outside the perimeter of the tear panel 20. The generally accepted purpose of the anti-fracture score 86 to those of ordinary skill in the art is to reduce residual stresses associated with the frangible score groove 22 so as to prevent or minimize the occurrence of microcracks in, or premature fracture along, the score groove 22. Thus, the anti-fracture score 86 has been found useful in protecting the frangible score groove 22. Ideally and by design, no rupture occurs along the anti-fracture score 86 in normal operation.

The opening sequence may be described as follows. The tab 26 begins in a stowage position as illustrated. The stowage position is the position of the tab 26 in which the beverage container is customarily delivered, i.e. handled subsequent to filling and prior to opening. Here, in the stowage position, the first axis 72 extends from the lift end 32 of the tab 26 through the nose end 30 of the tab 26. Thus, in the present invention, the pour panel opening position, or frangible score groove opening position, is also the stowage position. The user actuated lifting of the tab 26 is directed directly upwardly relative to the public side 34 of the center panel 12 without user introduced rotation of the rivet island of the tab 26 about the rivet 28 in either a clockwise or counterclockwise direction. The tear panel 20 is retained to the center panel 12 by the hinge segment 25 subsequent to opening.

As illustrated in FIGS. 3-20, an embodiment of a beverage can end 10 of the present invention includes one or more indicia or symbols 100 on the tear panel 20, serving the dual purpose of stiffening the tear panel 20 to enhance or improve openability and for communicating information to a user. Each symbol 100 may comprise one or more tactile relief features formed in the tear panel 20. The tactile relief features may be in high relief or low relief as viewed or felt on the public side 34 of the beverage can end 10. Each tactile relief feature is spaced at least 0.05 inches from the frangible score groove 22, preferably 0.05 inches from the anti-fracture score 86 when the anti-fracture score 86 is located on the tear panel 20. In either case, the tactile relief features are most preferably spaced at least 0.07 inches from the either score groove 22,86. The spacing contemplated herein is such that no portion of a tactile relief feature is closer to the score grooves 22,86 than the desired spacing, such that the closest distance between the tactile relief feature and the score grooves 22,86 is preferably at least 0.05 inches and most preferably at least 0.07 inches.

According to several embodiments, a symbol 100 comprises one or more tactile relief features in the form of shallow score grooves 104. The shallow score grooves 104 are generally on the order of about 0.001 inches, preferably no greater than 0.001 inches, in depth as measured from the public side of the tear panel 20. Here, the shallow score grooves 104 can be used to indicate and outline the perimeter of a symbol 100 or a portion of a symbol 100.

The shallow grooves 104 can be employed to produce fine detail of the symbol 100. As illustrated in, for example, FIGS. 9-18, the shallow grooves 104 represent pulp of a citrus fruit.

In several embodiments, one or more such symbols 100 comprise one or more tactile relief features in the form of one or more emboss and/or deboss beads 108. A bead 108 is formed by simultaneously deforming the public side 34 and the product side 35 of the tear panel 20, such that one of the public side 34 or the product side 35 is in high relief, i.e. raised as in an emboss, and the opposite side is in low relief, i.e. recessed as in a deboss. For the purposes of this discussion, when a bead 108 produces a high relief feature on the public side 34, the bead is an emboss bead; when a bead 108 produces a low relief feature on the public side 34, the bead is a deboss bead. This is the conventional manner of reference as understood by one of ordinary skill in the art.

One such bead 108 is a continuous curvilinear bead or beads forming a narrow channel or channels in the tear panel 20. This continuous curvilinear bead can be formed in high relief or low relief relative to the public side 34 of the tear panel 20 (compare FIGS. 3-5 with FIGS. 6-8). This technique is uniquely useful for defining an outline of a symbol 100 or portion thereof.

In at least one embodiment, the continuous curvilinear beads 108 form a skin of a citrus fruit and a plurality of individual sections or carpels of the fruit. In a preferred embodiment illustrated, a plurality of curvilinear beads 108 form the citrus fruit symbol 100. However, the citrus fruit symbol 100 may be formed by joining the individual continuous curvilinear beads into a single bead, provided the stiffness and general usability of the tear panel 20 as described herein are retained.

The continuous curvilinear bead 108 may be circumferential such that an interior area 112 of a portion of the symbol 100 is defined. The interior area 112 has an upper surface located at a height relative to the longitudinal axis 50 that is equal to a height of the tear panel 20 located on the opposite side of the bead 108.

In one embodiment, the tactile features include one or more shallow score grooves 104 located within a surface area of a bead 108. The shallow score 104 may be formed on the tear panel 20 prior to forming the bead 108 so that an opening of the shallow score groove 104 will widen upon formation of the bead 108.

In an embodiment, an outline or perimeter of a portion of a symbol 100 is formed by a continuous curvilinear bead. Here, the bead 108 is a narrow channel on either the public side 34 or the product side 35 of the tear panel 20.

In an embodiment, a portion of the interior area 112 may comprise one or more further tactile relief features. The tactile relief features may be beads 108 or shallow score grooves 104.

In several embodiments, one or more tactile features are asymmetrically located on the tear panel 20 relative to the first axis 72. Here, an overall symbol 100 created by one more tactile features may be symmetrical relative to the first axis 72, such that the symbol 100 exhibits bilateral symmetry relative thereto. However, it is contemplated that the principles of the present invention allow symbols 100 to be formed on the tear panel 20 which are asymmetrically skewed relative to the first axis 72, such that the symbol 20 lacks bilateral symmetry relative thereto. In at least one embodiment, individual beads 108 are asymmetrically positioned on the tear panel 20 relative to the first axis 72, yet the overall symbol 100 exhibits bilateral symmetry relative to the first axis 72.

As illustrated in the figures, a tactile feature forming a portion of a symbol 100 is non-uniformly spaced from the frangible score groove 22. Thus, the tactile feature departs from a shape of the score groove 22. Thus, the tactile feature is asymmetrical relative to the frangible score groove 22. The tactile feature may be a bead 108 or a shallow groove 104.

In an embodiment, one or more such symbols 100 are located entirely within an arc area 106 of a circular arc subtending a 160 degree angle, more preferably within an arc area of a circular arc subtending a 150 degree angle, and most preferably completely within an arc area of a circular arc subtending a 120 degree angle as illustrated. In each case, the circular arc has a center point at the center point of the rivet 28 and is bisected by the first axis 72.

In an embodiment, one or more relief features forming a symbol 100 have a perimeter wherein a shape of the perimeter is non-circular.

In an embodiment, a symbol 100 located on the tear panel 20 and formed by one or more relief features is spaced from the nose end 30 of the tab 26 such that no portion of the symbol 100 is located under the tab 26.

In an embodiment, a symbol 100 comprises a plurality of beads 108 wherein each bead 108 has an irregularly shaped perimeter. Here, the beads 108 may be an irregular polygon.

In an embodiment, a symbol 100 comprises a plurality of beads 108. Each of the plurality of beads 108 has a surface area. A vertical displacement of each bead 108 relative to the longitudinal axis 50 is inversely proportional to the surface area of the bead 108. Thus, a first bead 108 having a larger surface area will have a vertical displacement that is less than a vertical displacement of a second bead having a smaller surface area relative to the surface area of the first bead.

In an embodiment, the symbol 100 comprises one or more beads 108 in which the vertical displacement relative to the longitudinal axis 50 of a surface area of each bead 108 varies over the surface area. The vertical displacement may decrease as a distance from the rivet 28 or the tab 26 increases (see, for example, FIG. 23).

In an embodiment, the symbol 100 comprises one or more beads 108 in which the vertical displacement relative to the longitudinal axis 50 of a surface area of each bead 108 varies over the surface area. The vertical displacement may increase as a distance from the rivet 28 or the tab 26 increases.

In an embodiment, the symbol 100 comprises a coined segment 116 having a localized region of reduced thickness of the tear panel 20 relative to a thickness of adjacent portions of the tear panel 20. This coin segment 116 is located radially outwardly from the nose end 30 of the tab 26.

In an embodiment, the symbol 100 comprises the coined segment 116 intersecting a shallow score groove 104. In other words, one or more shallow scores 104 may be located on a surface area of a coined segment 116 of the tear panel 20. This coin segment 116 is located radially outwardly from the nose end 30 of the tab 26.

Figure 3:
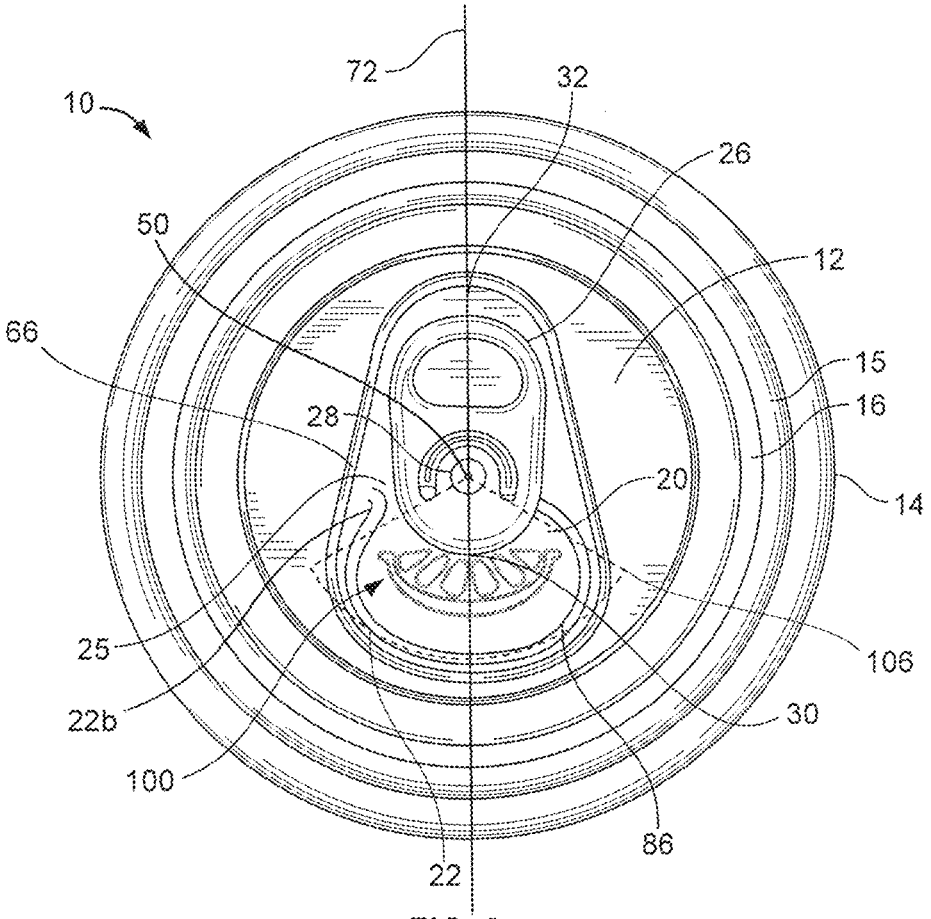
FIG. 3 is a top view of an SOT beverage can end of the present invention having a symbol on a displaceable tear panel, the symbol comprising a plurality of continuous curvilinear beads recessed in the displaceable tear panel.
Figure 4:
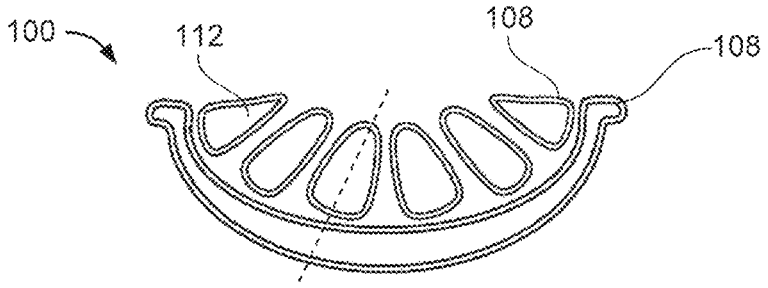
FIG. 4 is a magnified top view of the symbol illustrated on the can end of FIG. 3.
Figure 5:
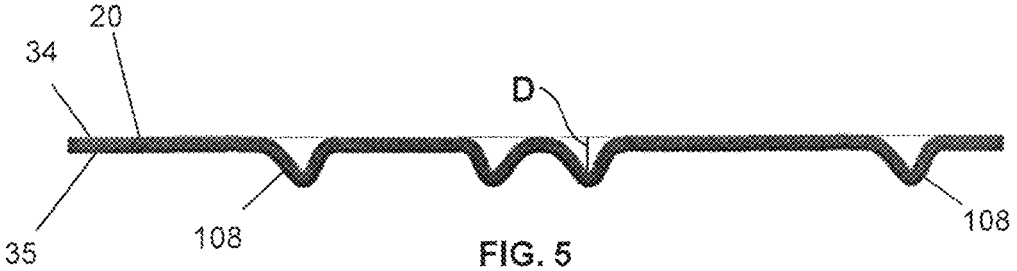
FIG. 5 is a sectional view taken along the dashed line on FIG. 4.

Referring specifically to FIGS. 3-5, a symbol 100 representing a citrus fruit, such as a lemon or lime, is located on the center panel 12. In this case, the symbol 100 is produced by relief features taking the form of a plurality of continuous curvilinear beads 108. In this example, a circumferential continuous curvilinear bead 108 forms a rind or skin of the citrus fruit symbol 100, and six additional circumferential continuous curvilinear beads 108 form wedges or segments of the citrus fruit. The circumferential beads 108 are recessed within the tear panel 20. The beads 108 have a depth D which is measured relative to the longitudinal axis from an opening of the beads 108 downwardly to the public side 34 of the tear panel 20. The depth D of a bead 108 may be inversely proportional to the surface area of the opening of the bead 108 and/or the surface area of the section of the tear panel 20 that makes up the bead 108.

Figure 6:
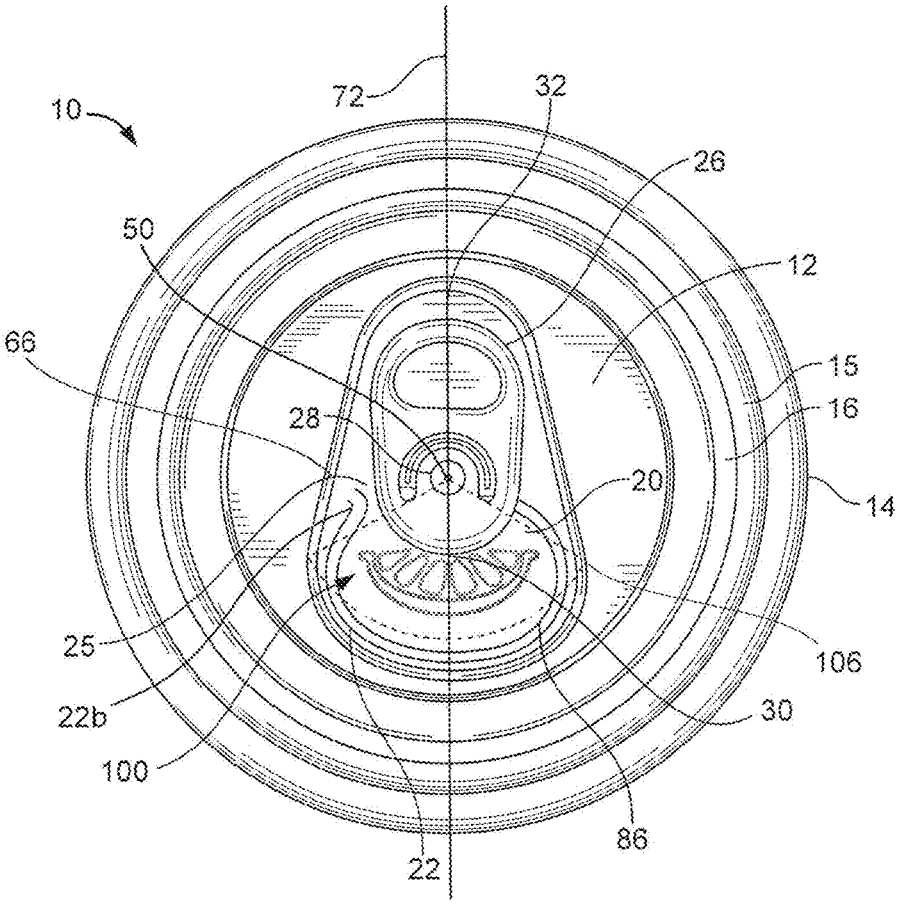
FIG. 6 is a top view of an SOT beverage can end of the present invention having a symbol on a displaceable tear panel, the symbol comprising a plurality of continuous curvilinear beads embossed on the displaceable tear panel.
Figure 7:
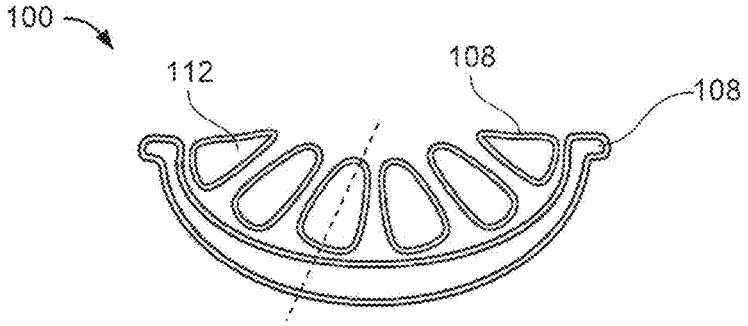
FIG. 7 is a magnified top view of the symbol illustrated on the can end of FIG. 6.
Figure 8:
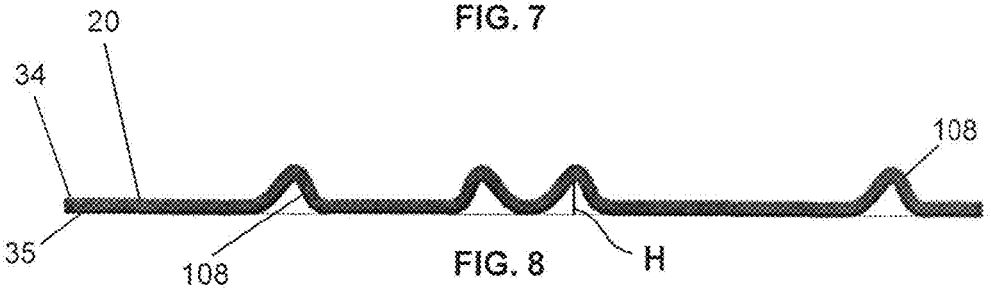
FIG. 8 is a sectional view taken along the dashed line on FIG. 7.

The can end 10 illustrated in FIGS. 6-8 is very similar to the previous example. Here, the circumferential beads 108 are embossed or raised on the tear panel 20 relative to the public side 34. In accordance with the definition of a bead as used herein, the product side 35 has a recess corresponding to the raised emboss on the public side 34. These beads have a height H which is measured relative to the longitudinal axis 50 from the opening of the beads 108 adjacent the product side 35 of the tear panel upwardly to the product side 35 of the tear panel 20.

It should be noted that, while FIGS. 3-5 and 6-8 show consistency with respect to the orientation of the beads 108, one or more beads 108 may be embossed while the others are debossed. For example, the bead 108 representing the rind may be debossed when the beads 108 representing the wedges may be embossed. The decision whether to produce beads in high relief or low relief relative to the public side 34 is made based on the necessary physical properties of the tear panel 20 needed to produce a suitable can end 10.

Figure 9:
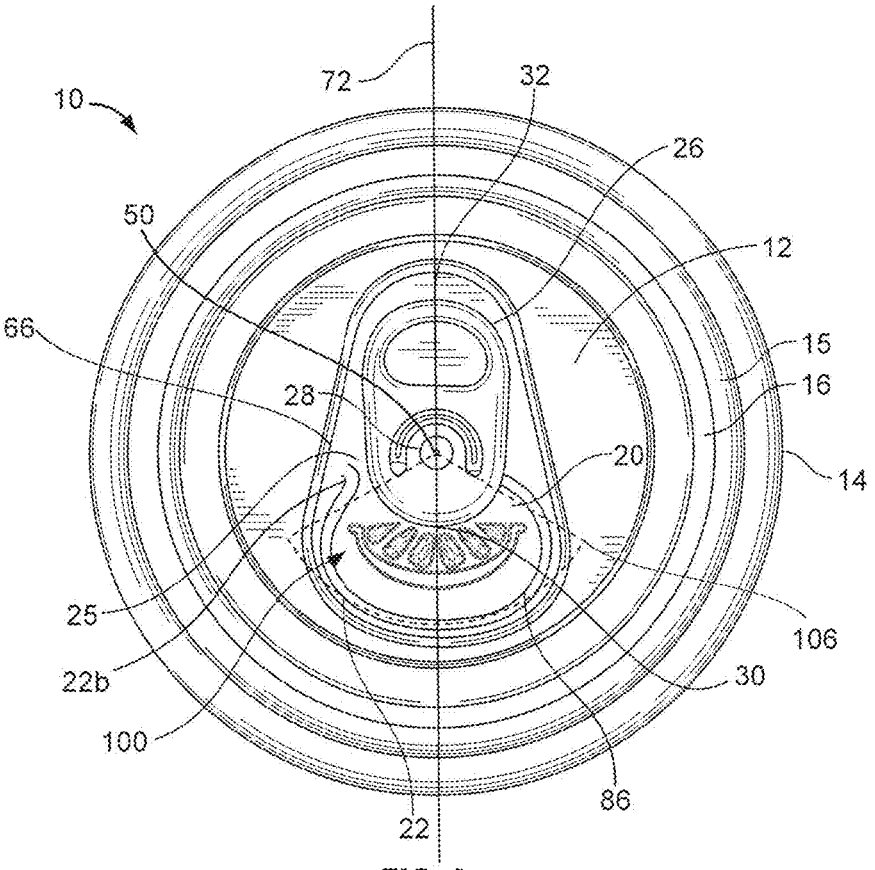
FIG. 9 is a top view of an SOT beverage can end of the present invention having a symbol on a displaceable tear panel, the symbol comprising a plurality of continuous curvilinear beads recessed in the displaceable tear panel and shallow score grooves within a surface area defined by a circumference of some of the continuous curvilinear beads to indicate further detail on the symbol.
Figure 10:
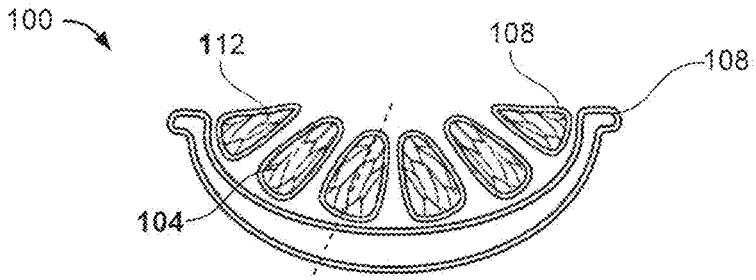
FIG. 10 is a magnified top view of the symbol illustrated on the can end of FIG. 9.
Figure 11:
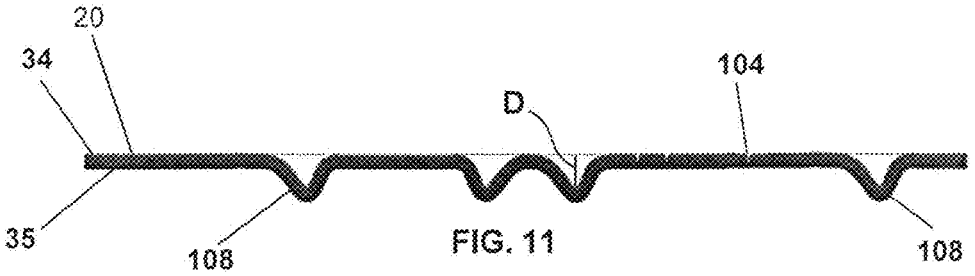
FIG. 11 is a sectional view taken along the dashed line on FIG. 10.

The example illustrated in FIGS. 9-11 is identical to the example of FIGS. 3-5, except for the addition of shallow score grooves 104. The shallow grooves 104 are located within a surface area of the tear panel 20 defined by the interior of the circumferential beads 108 representing the wedges of the citrus fruit. These shallow grooves 104 are added to represent pulp within the wedges.

Figure 12:
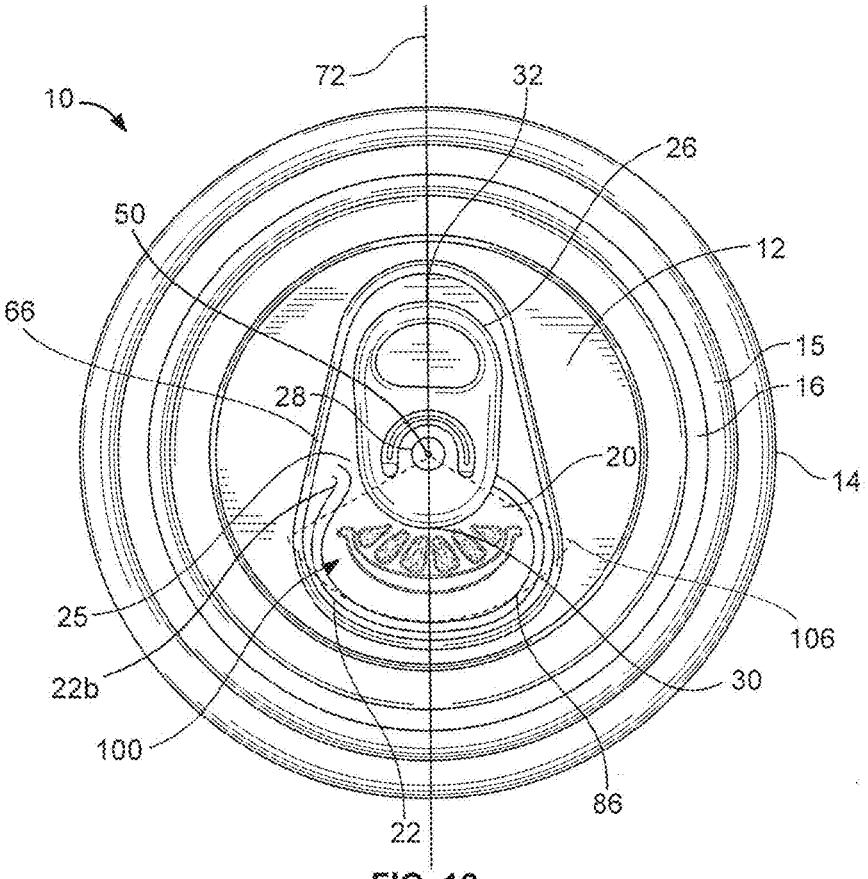
FIG. 12 is a top view of an SOT beverage can end of the present invention having a symbol on a displaceable tear panel, the symbol comprising a plurality of continuous curvilinear beads embossed in the displaceable tear panel and shallow score grooves within a surface area defined by a circumference of some of the continuous curvilinear beads to indicate further detail on the symbol.
Figure 13:
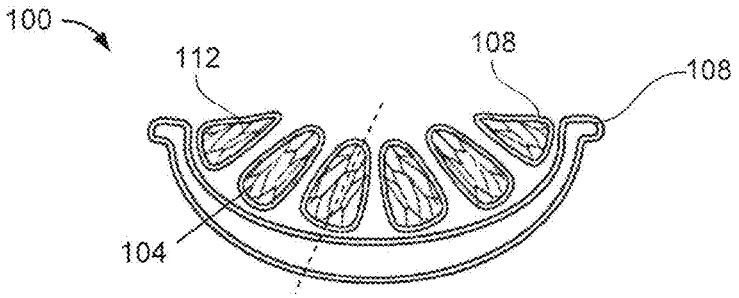
FIG. 13 is a magnified top view of the symbol illustrated on the can end of FIG. 12.
Figure 14:
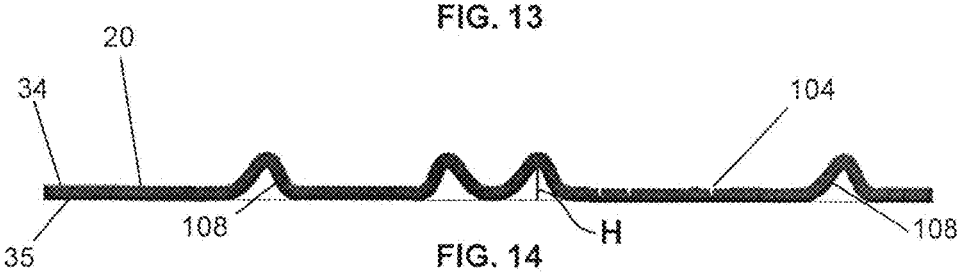
FIG. 14 is a sectional view taken along the dashed line on FIG. 13.

The example illustrated in FIGS. 12-14 is identical to the example of FIGS. 6-9, except for the addition of shallow score grooves 104 similar to the previous example.

Figure 15:
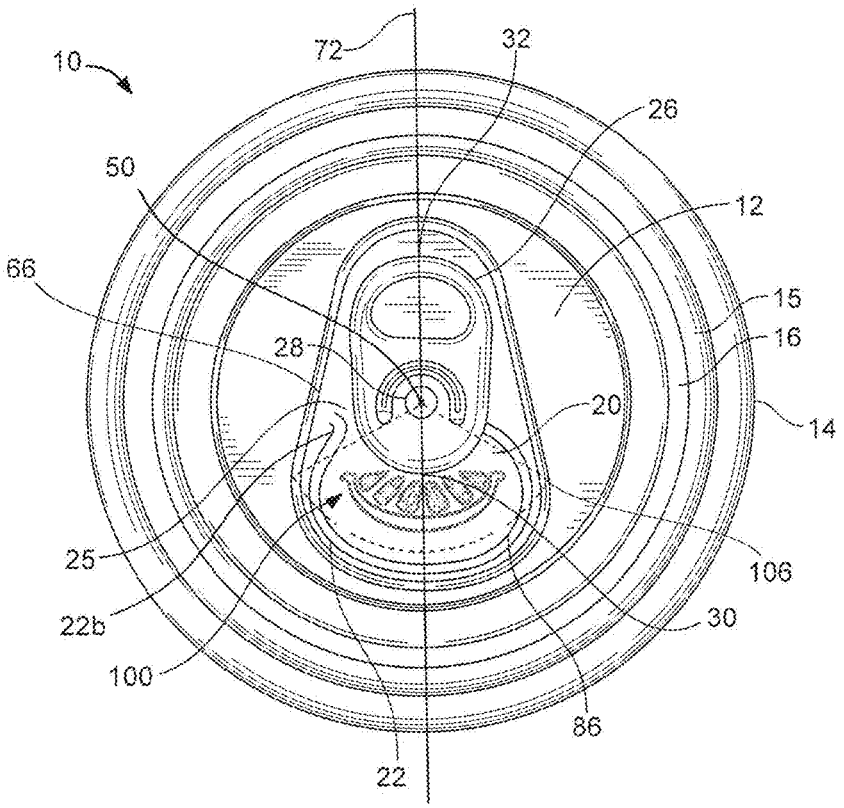
FIG. 15 is a top view of an SOT beverage can end of the present invention having a symbol on a displaceable tear panel, the symbol comprising a plurality of beads recessed in the displaceable tear panel and shallow score grooves within a surface area of some of the beads to indicate further detail on the symbol.
Figure 16:
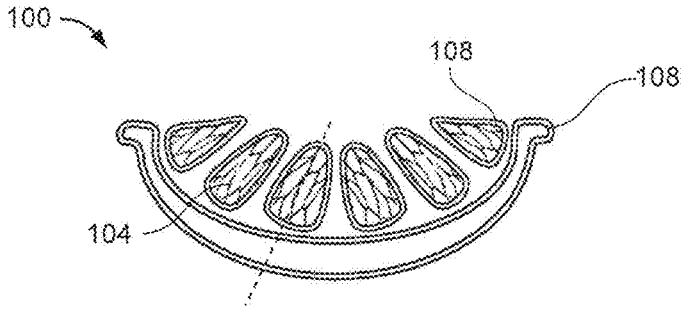
FIG. 16 is a magnified top view of the symbol illustrated on the can end of FIG. 15.
Figure 17:
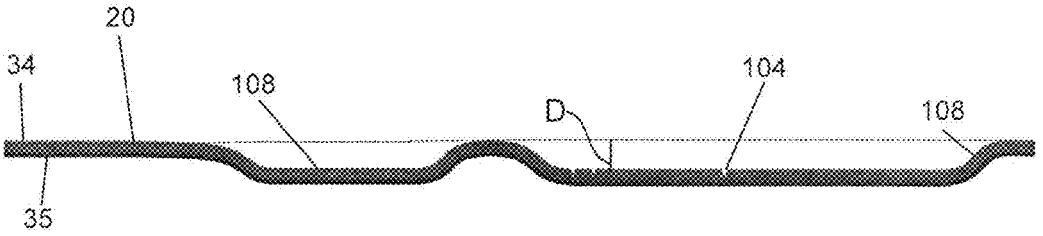
FIG. 17 is a sectional view taken along the dashed line on FIG. 16.

Referring to FIGS. 15-17, an example of a can end 10 having a symbol 100 recessed within the tear panel 20 is illustrated. Here, a citrus fruit symbol is formed by a plurality of recessed beads 108. The beads 108 representing the wedges of the fruit have a surface area in which shallow grooves 104 are located to represent pulp.

Figure 18:
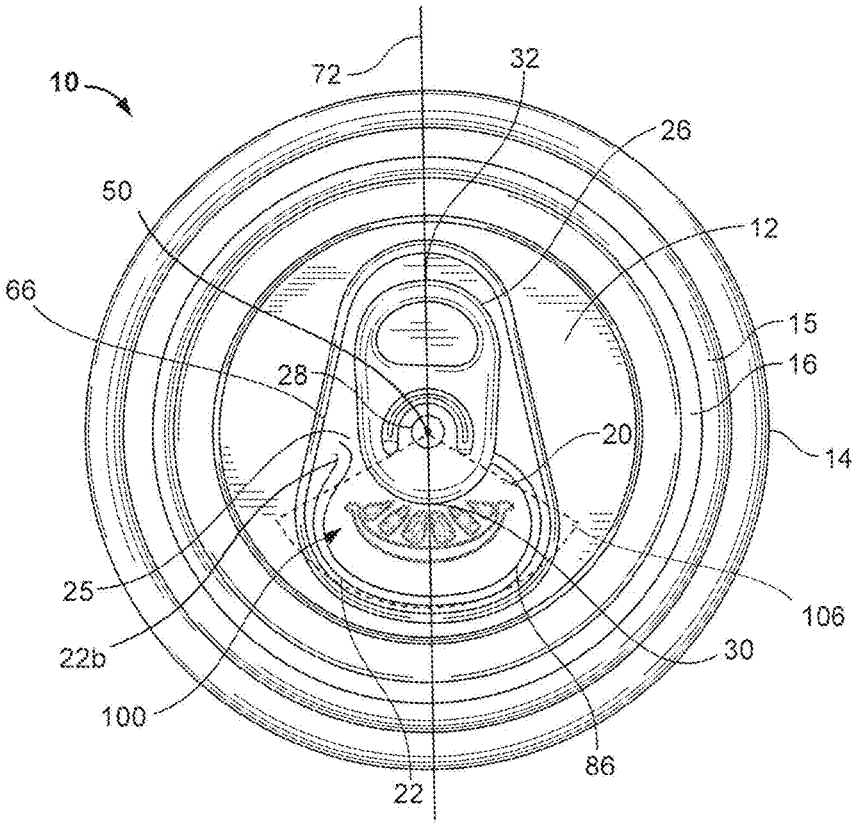
FIG. 18 is a top view of an SOT beverage can end of the present invention having a symbol on a displaceable tear panel, the symbol comprising a plurality of beads embossed on the displaceable tear panel and shallow score grooves within a surface area of some of the beads to indicate further detail on the symbol.
Figure 19:
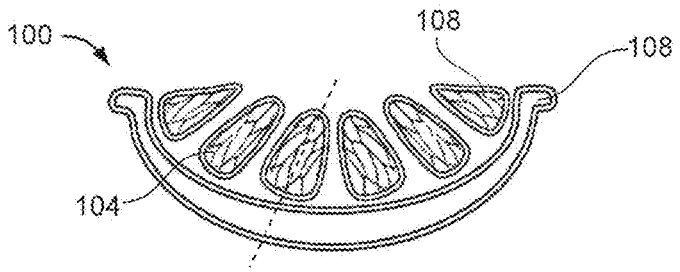
FIG. 19 is a magnified top view of the symbol illustrated on the can end of FIG. 18.
Figure 20:
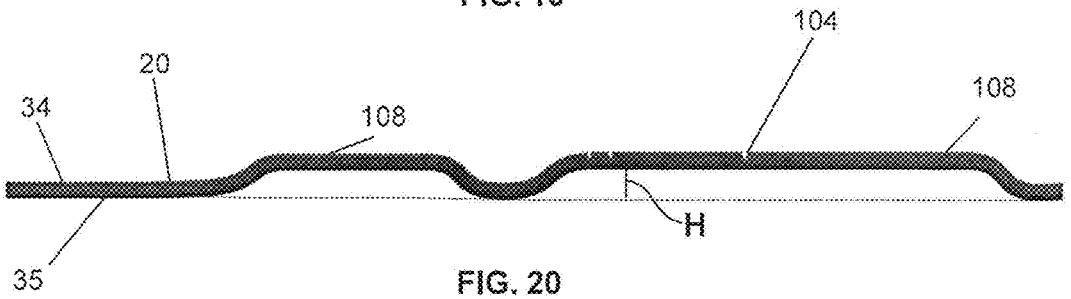
FIG. 20 is a sectional view taken along the dashed line on FIG. 19.

The example illustrated in FIGS. 18-20 is similar to the previous example; however, the beads 108 are embossed relative to the public side 34 of the tear panel 20.

Figure 21:
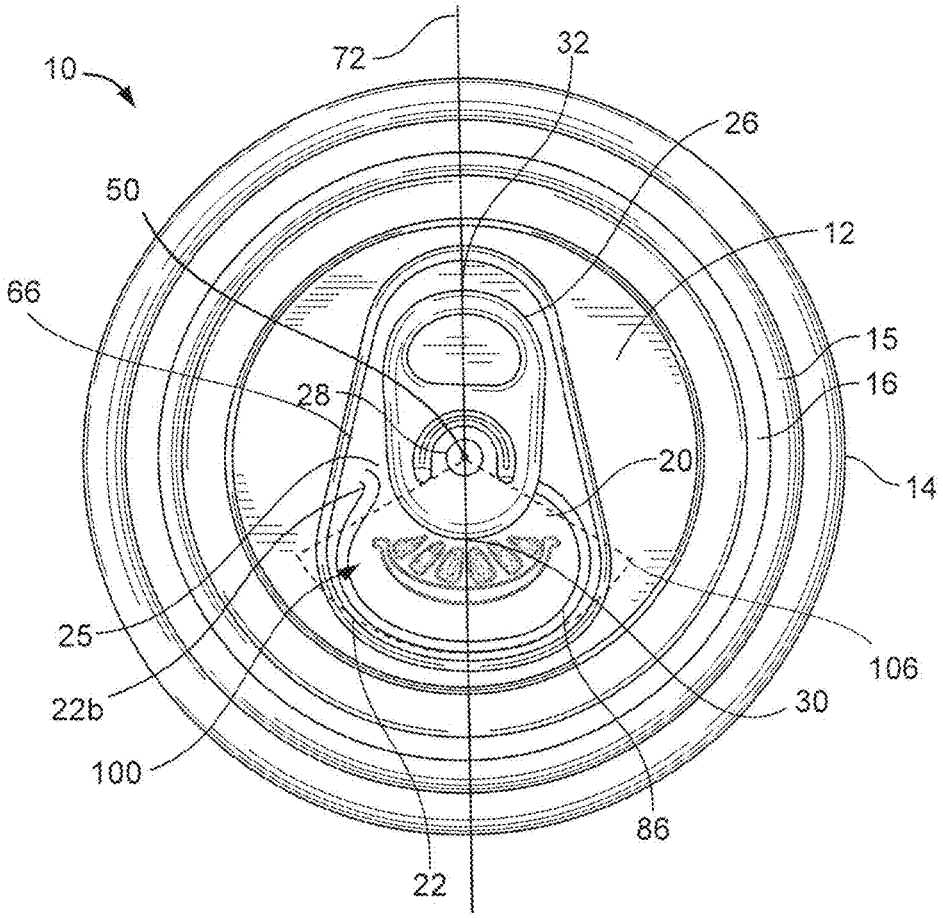
FIG. 21 is a top view of an SOT beverage can end of the present invention having a symbol on a displaceable tear panel, the symbol comprising a plurality of beads recessed in the displaceable tear panel wherein some of the beads have a depth that decreases as it extends farther from the rivet, and shallow score grooves are within a surface area of some of the beads to indicate further detail on the symbol.
Figure 22:
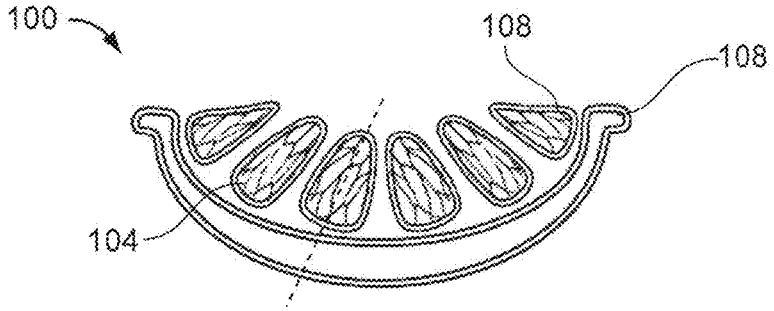
FIG. 22 is a magnified top view of the symbol illustrated on the can end of FIG. 21.
Figure 23:
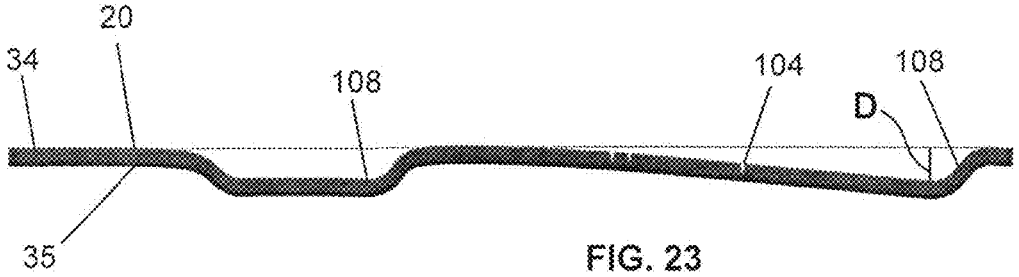
FIG. 23 is a sectional view taken along the dashed line on FIG. 22.

In FIGS. 21-23, the beads 108 representing the wedges of the citrus fruit are recessed within the tear panel 20. These beads 108 have a variable depth D. In the region of the tear panel 20 located radially outwardly of, but adjacent to, the tab nose 32, the beads 108 representing the wedges of the citrus fruit are recessed. As the beads 108 extend radially outwardly therefrom, their respective depths become shallower until they blend smoothly with the remaining portion of the tear panel 20.

Figure 24:
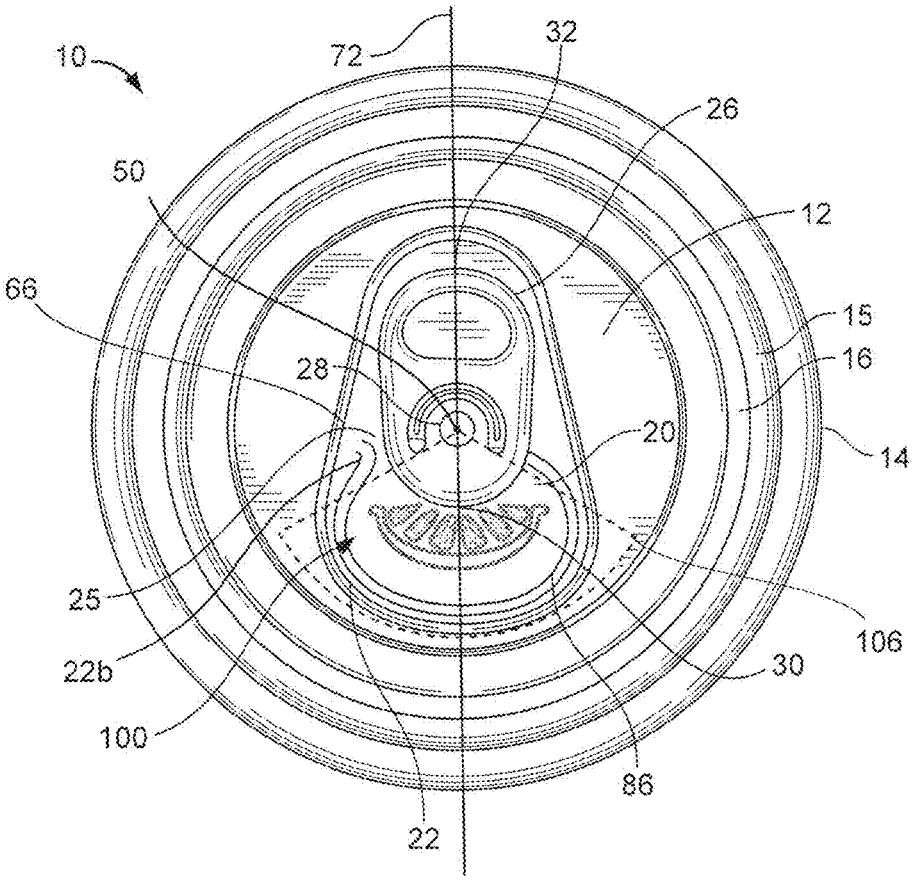
FIG. 24 is a top view of an SOT beverage can end of the present invention having a symbol on a displaceable tear panel, the symbol comprising a plurality of beads embossed on the displaceable tear panel wherein some of the beads have a height that decreases as it the extends farther from the rivet, and shallow score grooves are within a surface area of some of the beads to indicate further detail on the symbol.
Figure 25:
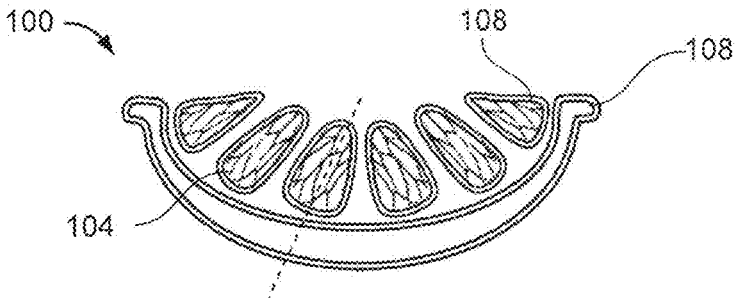
FIG. 25 is a magnified top view of the symbol illustrated on the can end of FIG. 24.
Figure 26:
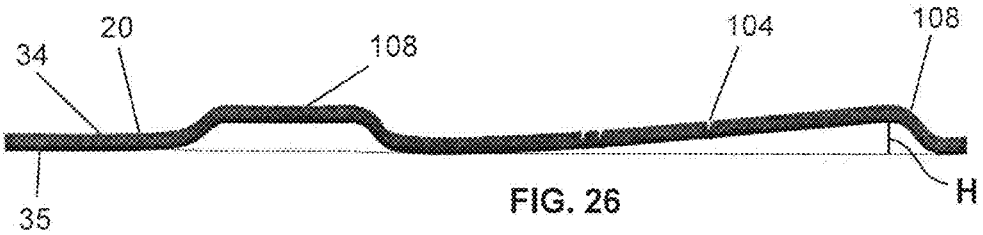
FIG. 26 is a sectional view taken along the dashed line on FIG. 25.

The example of FIGS. 24-26 is similar to the previous example. Here, however, the beads 108 are embossed. The beads 108 representing the wedges of the citrus fruit have a variable height H.

Figure 27:
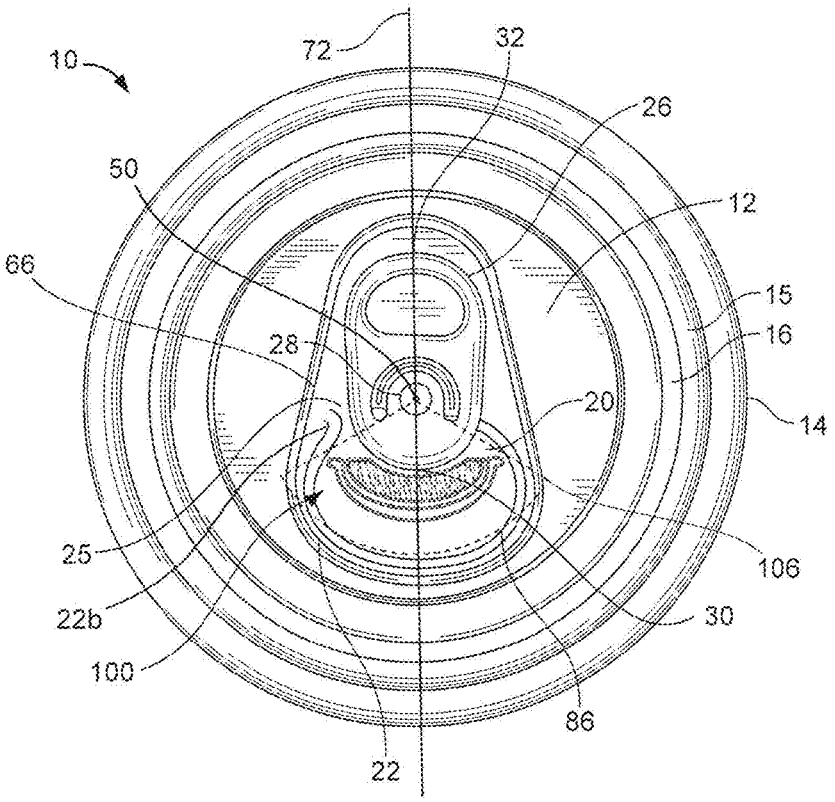
FIG. 27 is a top view of an SOT beverage can end of the present invention having a symbol on a displaceable tear panel, the symbol comprising a plurality of beads, one of which is a continuous curvilinear bead, on the displaceable tear panel wherein one bead has a depth that decreases as it extends farther from the rivet, and shallow score grooves are within a surface area of the bead to indicate further detail on the symbol.
Figure 28:
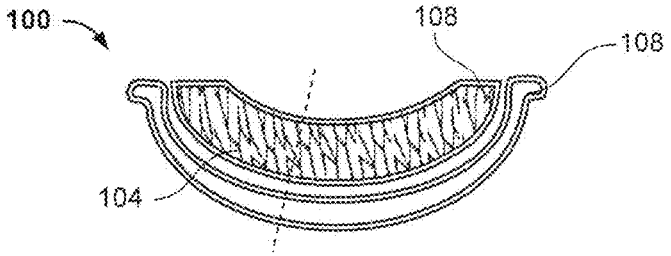
FIG. 28 is a magnified top view of the symbol illustrated on the can end of FIG. 27.
Figure 29:
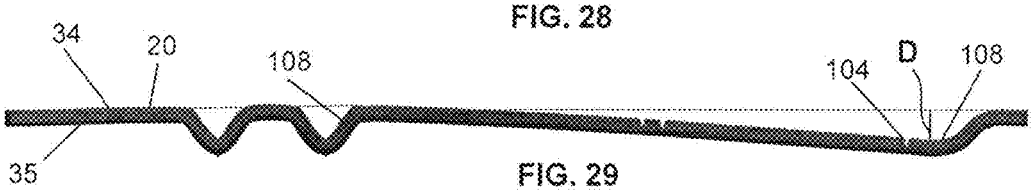
FIG. 29 is a sectional view taken along the dashed line on FIG. 28 showing one option of a recessed continuous curvilinear bead.
Figure 30:
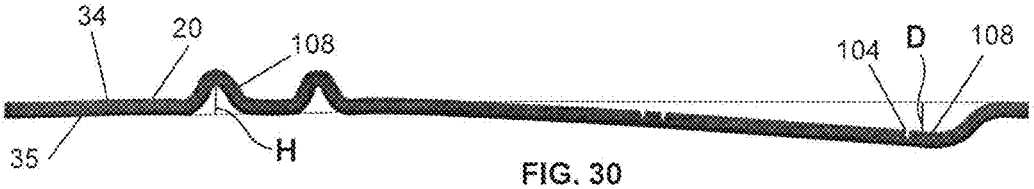
FIG. 30 is a sectional view taken along the dashed line on FIG. 28 showing one option of an embossed continuous curvilinear bead.

FIGS. 27 and 28 illustrate an alternative citrus fruit symbol 100, showing a single wedge. The wedge is formed from a single recessed bead 108 having a variable depth D such that the maximum depth is located adjacent, but spaced from, the tab nose 30, and the bead 108 becomes progressively shallower as a distance from the tab 26 increases along the first axis 72. The bead 108 representing the rind of the fruit can be expressed in either deboss form (FIG. 29) or emboss form (FIG. 30). Shallow score grooves 104 are located within the surface area of the bead representing the fruit wedge to resemble pulp. A portion of the bead 108 representing the wedge has a curved shape adjacent the nose of the tab 26 that generally follows a curvature of the tab 26.

Figure 31:
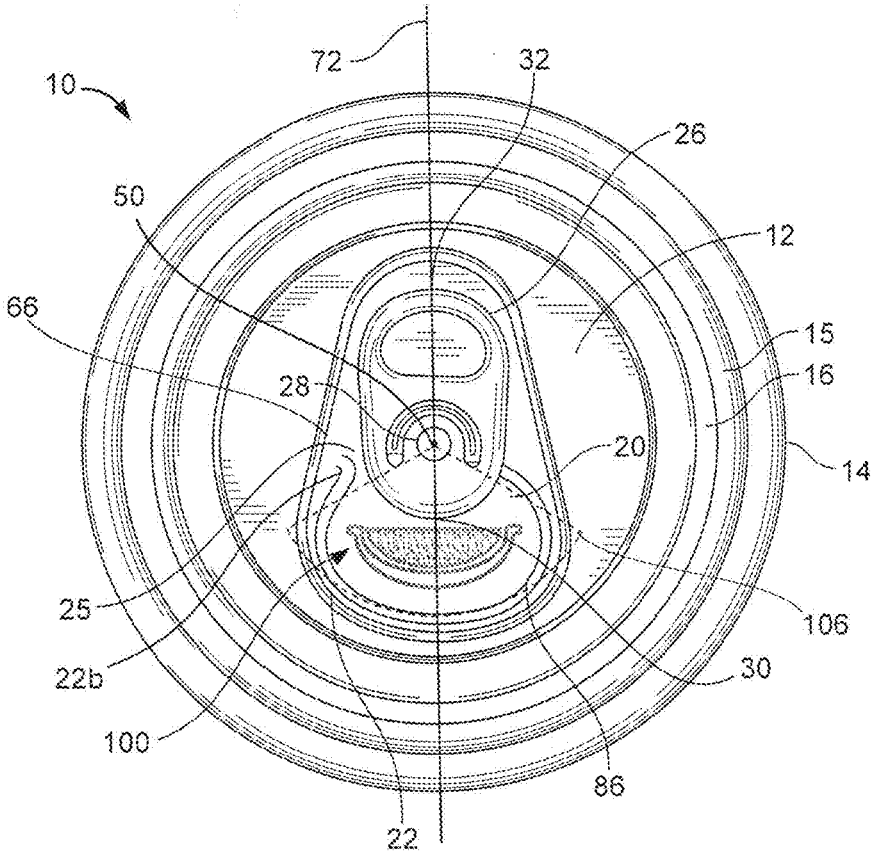
FIG. 31 is a top view of an SOT beverage can end of the present invention having a symbol on a displaceable tear panel, the symbol comprising a plurality of beads, one of which is a continuous curvilinear bead, on the displaceable tear panel wherein one bead has a depth that decreases as it extends farther from the rivet, and shallow score grooves are within a surface area of the bead that has been coined to indicate further detail on the symbol.
Figure 32:
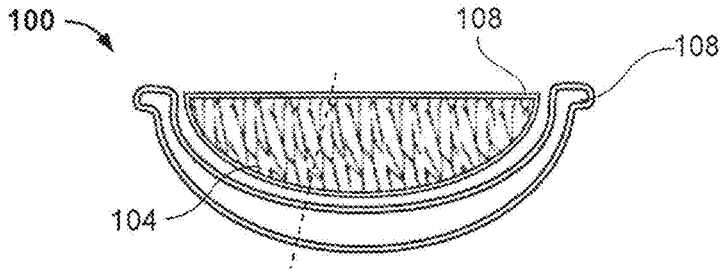
FIG. 32 is a magnified top view of the symbol illustrated on the can end of FIG. 31.
Figure 33:
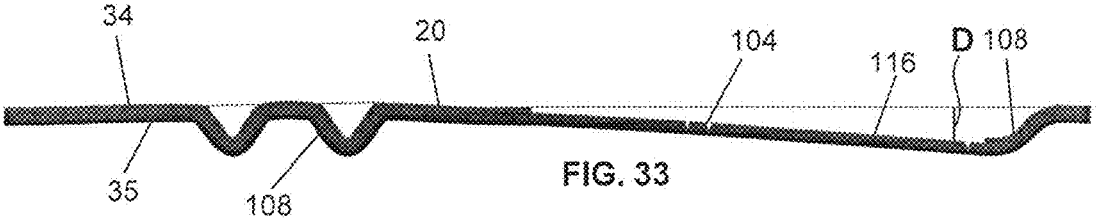
FIG. 33 is a sectional view taken along the dashed line on FIG. 32.

FIGS. 31-33 illustrate yet another alternative citrus fruit symbol 100. Here, the symbol is spaced radially outwardly along the first axis 72 from the tab 26. The bead 108 representing the wedge has a variable depth D similar to the variable depths described above. This embodiment also illustrates how coining can be used to improve the physical properties of the tear panel 20 and to move a volume of metal that can be used to form the details of the symbol 100. Accordingly, a coined segment 116 of the tear panel 20 is located within the surface area of the wedge bead 108 and spaced radially outwardly from the tab 26.

Figure 35A:
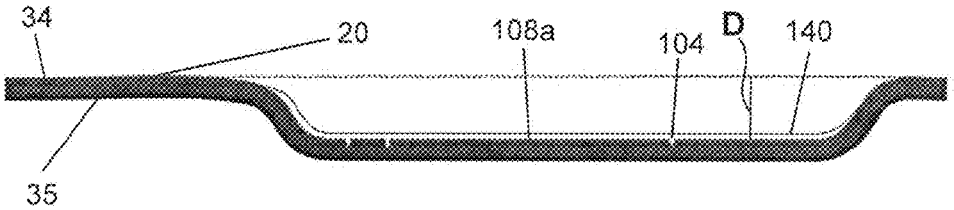
FIG. 35A is a section view taken through the dashed line A of the symbol of FIG. 34 showing a coating on the public side of a recessed bead.
Figure 35B:
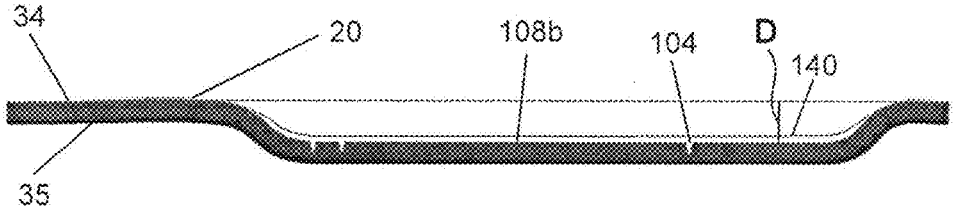
FIG. 35B is a section view taken through the dashed line B of the symbol of FIG. 34 showing a coating on the public side of a recessed bead and a depth less than a depth of the bead illustrated in FIG. 35A due to the larger surface area and larger opening surface area on the bead.

FIGS. 35A and 35B also show a layer of pigment 140 on the beads 108*a,b*. The layer of pigment 140 can be used to further distinguish the symbol 100 from other portions of the tear panel 20 and the remaining portions of the can end 10. The layer of pigment 140 can be completely opaque or somewhat translucent to reveal the shallow score grooves 104 beneath the layer 140.

The coined segment 116 is a portion or surface area of the tear panel 20 which has been compressed between two tools to produce a localized area of reduced thickness of the tear panel 20 relative to a thickness of adjacent portions of the tear panel 20. Coining is known to provide structural strengthening but also moves a volume of metal which could cause warping or an "oil can" effect. However, here, the volume of metal is desirable to provide a volume of metal from which to form the decorative beading required of the present invention.

One or more coined segments can be employed on any of the embodiments disclosed herein to provide desirable structural properties and/or a volume of metal from which the symbol 100 may be formed.

Figure 34:
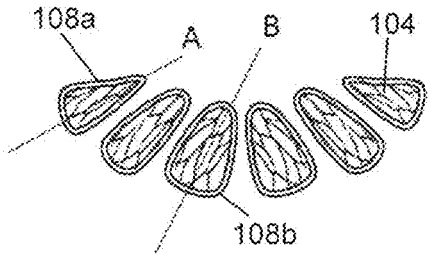
FIG. 34 is a top view of a symbol.

As illustrated in FIGS. 34-35B, a vertical displacement of the center panel 12 parallel to the longitudinal axis 50 caused by a bead 108*a,b* is inversely proportional to its surface area or the area of the opening of the bead 108*a,b*. FIGS. 34-35B show that a depth D of bead 108*a* is greater than the depth D of bead 108*b* wherein the surface area of bead 108*b* is greater than the surface area of bead 108*a*. This holds true for the area of the openings of the beads 108*a,b* as well. One of ordinary skill would readily grasp that the relationship holds true for embossed beads as it is for the debossed beads 108*a,b* shown, and that the relationship is related to the displacement of the center panel 12 more so than upward or downward orientation of the displacement. In other words, one bead may be debossed and another may be embossed, but their respective displacement, either height or depth, in this embodiment is dependent on the surface areas of the bead, not the orientation of the bead. However, one of ordinary skill would further understand that in a given situation, a deboss bead may function better than a similarly shaped emboss bead in terms of improving or enhancing the openability of the tear panel 20.

In an embodiment, the symbol 100 is formed in a conversion press. An anvil may be provided to support either of the public side or the product side 35 as a shaped tool strikes the opposing side. The anvil could be shaped to correspond to the desired shape of the tear panel 20 and a negative of the tool. The anvil may be produced from natural or synthetic rubber.

Preferably, a depth D and a surface area of each bead 108 are selected to maintain or create a desired stiffness in the tear panel 20. The depth D of each bead 108 is measured from a plane defining an opening of each bead along a direction parallel to the longitudinal axis 50. The planes are shown in dashed lines on the drawings. It should be noted that in some embodiments, as discussed above, the depth D of a given bead or of all of the beads in a symbol 108 may vary relative to a radial distance from the rivet or from a distance from the frangible score 22. Stiffness of the tear panel 20 may also be improved by including one or more coined segments 116 on the tear panel 20 radially outwardly from the nose end 30 of the tab 26. Coining may also be employed to produce slack metal in the tear panel from which tactile features can be created.

The symbol 100 is generally placed on the tear panel 20 and spaced completely and entirely from a perimeter of the tab 26. In this way, no portion of the symbol 100 lies beneath the tab 26.

The terms "first," "second," "upper," "lower," "top," "bottom," etc. are used for illustrative purposes relative to other elements only and are not intended to limit the embodiments in any way. The term "plurality" as used herein is intended to indicate any number greater than one, either disjunctively or conjunctively as necessary, up to an infinite number. The terms "joined," "attached," and "connected" as used herein are intended to put or bring two elements together so as to form a unit, and any number of elements, devices, fasteners, etc. may be provided between the joined or connected elements unless otherwise specified by the use of the term "directly" and/or supported by the drawings. The term "bead" as used herein indicates forming a tactile feature in either high relief or low relief wherein a recess is formed in either the public side or product side of the beverage can end with a corresponding low relief or high relief on the opposite side of the beverage can end. Beading is well-known in the art as differentiated from other forming techniques.

While the specific embodiments have been illustrated and described, numerous modifications come to mind without significantly departing from the spirit of the invention, and the scope of protection is only limited by the scope of the accompanying Claims.

What is claimed is:

1. A beverage can end comprising:

a circumferential curl positioned about a longitudinal axis defining a perimeter of the beverage can end;

a circumferential wall positioned radially inwardly of the circumferential curl and extending downwardly therefrom;

a center panel located radially inwardly of the circumferential wall having a public side and an opposing product side, the center panel comprising:

a frangible score groove within the center panel having a first end spaced from a second end;

a displaceable tear panel defined by the frangible score groove and a non-frangible hinge portion of the center panel located between the first end and the second end of the frangible score which retains the displaceable tear panel to the center panel subsequent to opening, the displaceable tear panel comprising a symbol formed from a relief feature for conveying information to a user and spaced at least 0.050 inches radially inwardly of the frangible score groove such that no portion of the symbol is closer than 0.050 inches to the frangible score;

a tab having a lift end and a nose end extending over a portion of the displaceable tear panel;

a rivet;

a means for strengthening the beverage can end located radially outwardly of the center panel between the center panel and the circumferential wall; and a score groove in the displaceable tear panel located at least 0.050 inches radially inwardly of the frangible score groove and forming a portion of the symbol conveying information to a user.

2. The beverage can end of claim 1 wherein a depth of the score groove is no greater than 0.001 inches.

3. The beverage can end of claim 1 wherein the score groove is asymmetrical relative to a first diametric axis extending through a center of the rivet and the lift end and the nose end of the tab.

4. The beverage can end of claim 1 wherein the score groove is asymmetrical relative to the frangible score groove.

5. The beverage can end of claim 1 wherein the score groove is asymmetrical relative to the frangible score groove and is located completely beyond a perimeter of the tab.

6. The beverage can end of claim 1 wherein the score groove is located entirely within an arc area of an arc of a circle subtending an angle of less than 120 degrees, having a center point common with a center of the rivet, and bisected by the first axis.

7. The beverage can end of claim 1 wherein the score groove is located within a surface area of a bead forming a first relief feature on the public side of the tear panel and a corresponding second relief feature on the product side of the tear panel.

8. The beverage can end of claim 7 wherein the bead forms a portion of the symbol for conveying information to a user.

9. The beverage can end of claim 1 further comprising:

a plurality of score grooves in the displaceable tear panel located at least 0.050 inches radially inwardly of the frangible score groove and forming a portion of the symbol conveying information to a user wherein no portion of the plurality of score grooves is closer than 0.050 inches to the frangible score.

10. The beverage can end of claim 1 further comprising:

an anti-fracture score spaced from the frangible score and generally following a shape thereof.

11. The beverage can end of claim 1 wherein a portion of the symbol is coined to produce a localized segment of reduced thickness of the tear panel relative to a thickness of adjacent portions of the tear panel.

12. The beverage can end of claim 1 wherein the symbol includes a layer of pigment deposited thereon.

13. The beverage can end of claim 1 wherein the symbol is located entirely within an arc area of an arc of a circle subtending an angle of less than 120 degrees, having a center point common with a center of the rivet, and bisected by the first axis.

14. The beverage can end of claim 1 wherein no portion of the symbol is nearer than 0.07 inches to the frangible score.

15. The beverage can end of claim 1 wherein the symbol is non-uniformly spaced from the frangible score groove.

16. The beverage can end of claim 1 wherein the symbol exhibits bilateral symmetry relative to a diametric axis passing through the lift end of the tab, a center of the rivet, and a nose end of the tab.

17. The beverage can end of claim 1 wherein no portion of the symbol lies beneath the tab.

18. The beverage can end of claim 1 further comprising a deboss panel recessed within the center panel in which the frangible score groove is located within.

19. A beverage can end comprising:

a circumferential curl positioned about a longitudinal axis defining a perimeter of the beverage can end;

a circumferential wall positioned radially inwardly of the circumferential curl and extending downwardly therefrom;

a center panel located radially inwardly of the circumferential wall having a public side and an opposing product side, the center panel comprising:

a frangible score groove within the center panel having a first end spaced from a second end;

a displaceable tear panel defined by the frangible score groove and a non-frangible hinge portion of the center panel located between the first end and the second end of the frangible score which retains the displaceable tear panel to the center panel subsequent to opening, the displaceable tear panel comprising a symbol formed from a relief feature for conveying information to a user and spaced at least 0.050 inches radially inwardly of the frangible score groove such that no portion of the symbol is closer than 0.050 inches to the frangible score;

a tab having a lift end and a nose end extending over a portion of the displaceable tear panel;

a rivet;

a means for strengthening the beverage can end located radially outwardly of the center panel between the center panel and the circumferential wall; and a plurality of beads formed in the displaceable tear panel displacing the public side and the product side of the center panel in an axial direction defined by the longitudinal axis, each bead having an outer perimeter spaced at least 0.050 inches from the frangible score groove over an entire length of an outer perimeter of the bead, wherein each bead forms at least a portion of the symbol for conveying information to a user, wherein each bead is asymmetrically positioned on the tear panel relative to a first diametric axis extending through a center of the rivet and lift end and the nose end of the tab.

20. The beverage can end of claim 19 wherein each bead is located entirely within an arc area of an arc of a circle subtending an angle of less than 120 degrees, having a center point common with a center of the rivet, and bisected by the first axis.

21. The beverage can end of claim 19 wherein a first bead in the plurality of beads is embossed and a second bead in the plurality of beads is debossed.

22. The beverage can end of claim 19 wherein the symbol is a citrus fruit.

23. The beverage can end of claim 19 wherein at least one of the beads is a continuous curvilinear bead forming a narrow channel in the tear panel.

24. The beverage can end of claim 23 wherein the continuous curvilinear bead is circumferential.

25. The beverage can end of claim 19 wherein a depth of each bead is inversely proportional to a surface area of the bead.

26. The beverage can end of claim 19 wherein each of the plurality of beads is a deboss bead.

27. The beverage can end of claim 19 wherein each of the plurality of beads is an emboss bead.

28. The beverage can end of claim 27 wherein a height of each bead is inversely proportional to a surface area of the bead.

29. The beverage can end of claim 19 wherein at least one bead of the plurality of beads has a height that varies over a surface area of the at least one bead, wherein the height becomes shallower in an axial direction defined by the longitudinal axis as a distance from the tab increases, and wherein the at least one bead is raised in the tear panel relative to the public side.

30. The beverage can end of claim 19 wherein the plurality of beads improves the stiffness of the tear panel.

31. The beverage can end of claim 19 wherein a depth of each bead is inversely proportional to an area of an opening of the bead.

32. The beverage can end of claim 19 wherein a height of each bead is inversely proportional to an area of an opening of the bead.

33. The beverage can end of claim 19 wherein a continuous curvilinear bead of the plurality of beads is circumferential such that an interior area of a portion of the symbol is defined, wherein the interior area has an upper surface located at a height relative to the longitudinal axis that is equal to a height of the tear panel located on an opposite side of the continuous curvilinear bead.

34. A beverage can end comprising:

a circumferential curl positioned about a longitudinal axis defining a perimeter of the beverage can end;

a circumferential wall positioned radially inwardly of the circumferential curl and extending downwardly therefrom;

a center panel located radially inwardly of the circumferential wall having a public side and an opposing product side, the center panel comprising:

a frangible score groove within the center panel having a first end spaced from a second end;

a displaceable tear panel defined by the frangible score groove and a non-frangible hinge portion of the center panel located between the first end and the second end of the frangible score which retains the displaceable tear panel to the center panel subsequent to opening, the displaceable tear panel comprising a symbol formed from a relief feature for conveying information to a user and spaced at least 0.050 inches radially inwardly of the frangible score groove such that no portion of the symbol is closer than 0.050 inches to the frangible score;

a tab having a lift end and a nose end extending over a portion of the displaceable tear panel;

a rivet;

a means for strengthening the beverage can end located radially outwardly of the center panel between the center panel and the circumferential wall; and a plurality of beads formed in the displaceable tear panel displacing the public side and the product side of the center panel in an axial direction defined by the longitudinal axis, each bead having an outer perimeter spaced at least 0.050 inches from the frangible score groove over an entire length of an outer perimeter of the bead, wherein each bead forms at least a portion of the symbol for conveying information to a user, wherein at least one of the beads has a depth that varies over a surface area of the at least one bead, wherein the depth becomes shallower in an axial direction defined by the longitudinal axis as a distance from the tab increases, and wherein the at least one bead is a recess in the tear panel relative to the public side.

* * * * *